US009466191B2

(12) United States Patent
Wang et al.

(10) Patent No.: US 9,466,191 B2
(45) Date of Patent: Oct. 11, 2016

(54) ALARM DEVICE FOR SECURING A PORTABLE ELECTRONIC DEVICE BY DETECTING REMOVAL OF AN ATTACHED ELECTRICAL INTERFACE

(71) Applicants: Chyi-Cheng Wang, Taipei (TW); Chung-Chin Hsiao, Taipei (TW)

(72) Inventors: Chyi-Cheng Wang, Taipei (TW); Chung-Chin Hsiao, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 153 days.

(21) Appl. No.: 14/321,822

(22) Filed: Jul. 2, 2014

(65) Prior Publication Data

US 2015/0009032 A1 Jan. 8, 2015

Related U.S. Application Data

(60) Provisional application No. 61/843,052, filed on Jul. 5, 2013.

(30) Foreign Application Priority Data

May 27, 2014 (TW) ..... 103118443 A

(51) Int. Cl.
*G08B 13/14* (2006.01)

(52) U.S. Cl.
CPC ..... *G08B 13/1454* (2013.01)

(58) Field of Classification Search
CPC ..... G08B 13/1454
USPC ..... 340/568.2
See application file for complete search history.

(56) References Cited

U.S. PATENT DOCUMENTS 5,142,269 A * 8/1992 Mueller ..... G08B 13/1409 340/568.2
5,821,857 A * 10/1998 Rand ..... G08B 13/1454 340/568.8
6,300,874 B1 * 10/2001 Rand ..... G08B 13/1418 340/568.2
6,459,374 B1 * 10/2002 Rand ..... G08B 13/1418 340/568.2
2003/0122672 A1 * 7/2003 Billiard ..... G08B 13/1454 340/568.2
2005/0083200 A1 * 4/2005 Kim ..... G08B 13/1436 340/568.2
2009/0189765 A1 * 7/2009 Lev ..... E05B 45/005 340/568.2
2009/0267613 A1 * 10/2009 Terlizzi ..... H04L 27/32 324/538
2009/0267766 A1 * 10/2009 Pasma ..... G08B 13/1409 340/568.2
2012/0279780 A1 * 11/2012 Villarreal ..... G08B 13/1445 174/71 R
2013/0194096 A1 * 8/2013 Belden, Jr. ..... G08B 13/1463 340/568.4
2014/0035747 A1 * 2/2014 Ewen, III ..... G08B 13/1418 340/568.2
2014/0340225 A1 * 11/2014 Grant ..... G08B 13/1445 340/568.2

FOREIGN PATENT DOCUMENTS

| | | |
|---|---|---|
| CN | 1652559 | 8/2005 |
| CN | 102013145 | 4/2011 |
| CN | 102402831 | 4/2012 |
| CN | 202447239 | 9/2012 |

* cited by examiner

*Primary Examiner* — Benjamin C Lee
*Assistant Examiner* — Stephen Burgdorf
(74) *Attorney, Agent, or Firm* — Jianq Chyun IP Office

(57) ABSTRACT

An alarm device applied to a portable electronic device is provided. The alarm device includes a detection unit and a connecting unit. The detection unit includes a first data transfer pin, and the first transfer pin is preset to a first electric potential. When the portable electronic device is connected to the detection unit via the connecting unit, the first data transfer pin is connected to a second electric potential via the connecting unit. The detection unit is set in a detection mode. In the detection mode, when electric potential of the first data transfer pin is switched from the second electric potential to the first electric potential, the detection unit issues an alarm.

14 Claims, 6 Drawing Sheets

ALARM DEVICE FOR SECURING A PORTABLE ELECTRONIC DEVICE BY DETECTING REMOVAL OF AN ATTACHED ELECTRICAL INTERFACE

CROSS-REFERENCE TO RELATED APPLICATION

This application claims the priority benefits of U.S. provisional application Ser. No. 61/843,052, filed on Jul. 5, 2013 and Taiwan application serial no. 103118443, filed on May 27, 2014. The entirety of each of the above-mentioned patent applications is hereby incorporated by reference herein and made a part of this specification.

BACKGROUND OF THE INVENTION

1. Field of the Invention

The invention relates to an alarm device and, more particularly, to a portable electronic device with an alarm device.

2. Description of the Related Art

Since the size of the portable electronic device, such as a notebook (NB), an ultra-mobile personal computer (UMPC), a personal digital assistant (PDA) and other mobile phones which can surf the internet is small and light, it is easily stolen.

In order to prevent a portable electronic device from being stolen when it is exhibited or for sale, the portable electronic device is usually matched with a thin steel cable, and the thin steel cable is locked to a fixed object, such as a table's leg, to limit the portable area of the portable electronic device and prevent it from being stolen. Furthermore, an alarm with a buzzer and a battery is connected to the electronic device. When the alarm is at an alarm mode, if a vibration or a shaking is detected, or the thin steel cable is cut, the buzzer is generated, which ensures the devices secured.

However, if a lockset is used to limit a portable area of the electronic device, it needs complicated lock and unlock operations to set or disable the security system, which is rather inconvenient in use.

BRIEF SUMMARY OF THE INVENTION

An alarm device applied to a portable electronic device is provided in this disclosure. The alarm device includes a detection unit and a connecting unit. The detection unit includes a first data transfer pin, the first data transfer pin is preset to a first electric potential. The portable electronic device is electrically connected to detection unit via the connecting unit. When the portable electronic device is electrically connected to the detection unit via the connecting unit, the first data transfer pin is electrically connected to a second electric potential via the connecting unit, and the detection unit is set in a detection mode. In the detection mode, when electric potential of the first data transfer pin is switched from the second electric potential to the first electric potential, the detection unit issues an alarm.

As stated above, the connecting unit of the alarm device is specifically configured that the electric potential of the data transfer pin of the connecting port of the detection unit is different when the connecting port is disconnected or connected to the portable electronic device. Thus, the detection unit determines whether the portable electronic device is removed by detecting the electric potential of the data transfer pin. Since the connecting unit can be connected to the portable electronic device via a connecting port or an additional contact switch, the portability of the portable electronic device is thus improved. When the portable electronic device is exhibited, a high portability brings customers better using experiences.

Additionally, when the alarm device is set in an alarm mode, the alarm continues even the disconnected portable electronic device is connected again. A remote control unit or a key of the detection unit is required to turn off the alarm, and the alarm device is set in the detection mode again. This security process avoids thieves disconnecting and connecting the portable electronic device quickly and stealing it in a very short time.

In the alarm device, a control interface (such as a power key, an alarm sound rotary knob) of the detection unit or a remote control unit can be used to enable, set or disable the alarm function. No complicated locking and unlocking operations are required to set the alarm system. The detection unit can also charge to the portable electronic device to ensure the power supply for the portable electronic device. Furthermore, in order to avoid a power cut and the alarm system is failed; the detection unit further includes a battery module to maintain sufficient power for the operation of the alarm device.

DETAILED DESCRIPTION OF THE EMBODIMENTS

An alarm device is illustrated with embodiments to make illustration clear. Additionally, the same symbols denote the same components.

Figure 1A:
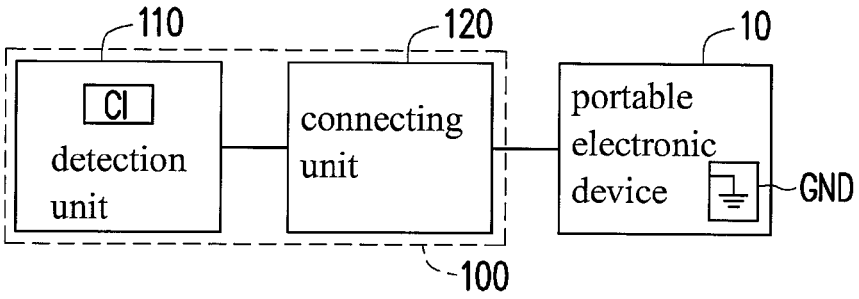
FIG. 1A is a block diagram showing an alarm device in an embodiment.
Figure 1B:
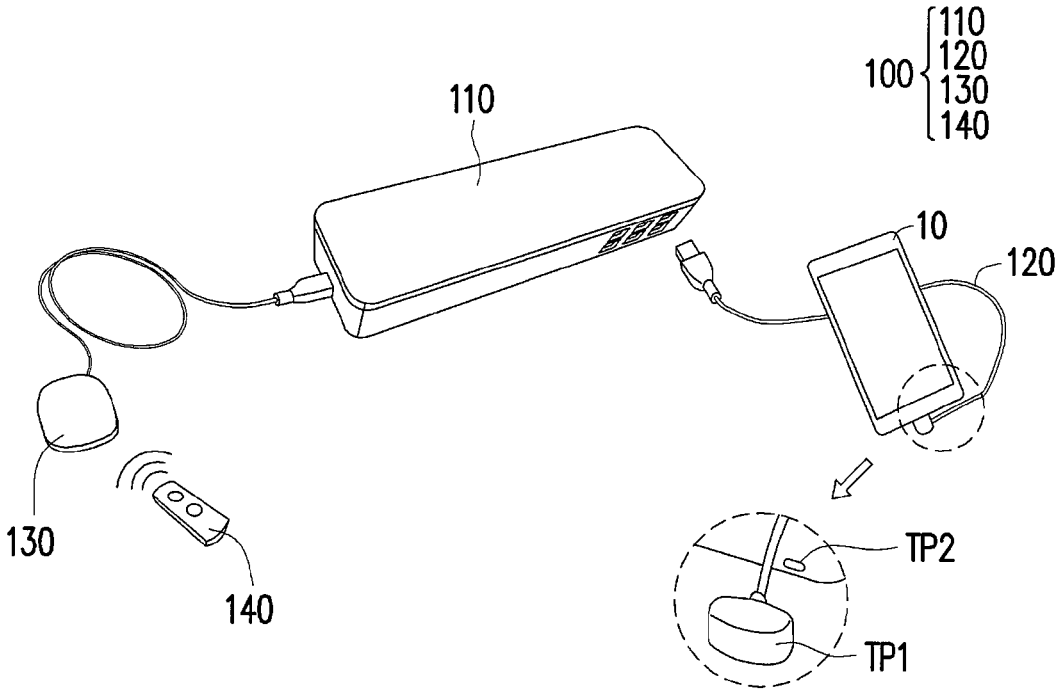
FIG. 1B is a schematic diagram showing a portable electronic device and an alarm device in an embodiment.

FIG. 1A is a block diagram showing an alarm device in an embodiment. FIG. 1B is a schematic diagram showing a portable electronic device and an alarm device in an embodiment. Please refer to FIG. 1A and FIG. 1B, an alarm device 100 cooperates with a portable electronic device 10. The alarm device 100 is connected to the portable electronic device 10, and the alarm device 100 generates an alarm (such as an alarm sound or light) when the portable electronic device 10 is detected been disconnected, so as to prevent the portable electronic device 10 from being stolen. The portable electronic device 10 may be a tablet computer, a mobile phone or a notebook, which is not limited herein.

The alarm device 100 includes a detection unit 110 and a connecting unit 120. The detection unit 110 includes at least one data transfer pin. When the detection unit 110 is not connected to the portable electronic device 10, the electric potential of the data transfer pin of the detection unit 110 is set as a first electric potential (for example, a high electric potential).

The portable electronic device 10 is electrically connected to the detection unit 110 via the connecting unit 120, and the connecting unit 120 is similar with a connecting wire whose length can be changed (as shown in FIG. 1B). The connecting unit 120 is electrically connected to the data transfer pin of the detection unit 110. The connecting unit 120 is electrically connected to the portable electronic device 10 via a pair of corresponding connecting ports (such as TP1 and TP2) or a contact switch (not shown).

Additionally, the detection unit 110 further includes a control interface CI. The control interface provides a control function interface for setting the alarm device 100. The user operates the alarm device 100 via the control interface CI, such as enabling an alarm function or adjusting an alarm volume, which is not limited herein.

In the embodiment, when the detection unit 110 is electrically connected to the portable electronic device 10 via the connecting unit 120, the data transfer pin of the detection unit 110 is electrically connected to a grounding terminal of the portable electronic device 10 through configuring the inner circuit of the connecting unit 120 (which is further illustrated hereinafter). Then, the electric potential of the data transfer pin of the detection unit 110 is switched from the first electric potential to the second electric potential (such as a low electric potential or a grounding electric potential). When the detection unit 110 determines the electric potential of the data transfer pin is switched from the first electric potential to the second electric potential, the detection unit 110 is set in a detection mode to detect whether the portable electronic device 10 is disconnected, and determines whether to issue an alarm.

In detail, when the detection unit 110 is in the detection mode, the data transfer pin of the detection unit 110 is connected to the grounding terminal GND of the portable electronic device 10 via the connecting unit 120. Regardless of that the detection unit 110 is disconnected to the connecting unit 120 or the connecting unit 120 is disconnected to the portable electronic device 10, the electric potential of the data transfer pin would be switched from the second electric potential to the first electric potential. Thus, the detection unit 110 can determine whether the portable electronic device 10 is disconnected via determining whether the electric potential of data transfer pin is switched from the second electric potential to the first electric potential. When the detection unit 110 determines the portable electronic device 10 is disconnected, it issues an alarm, such as a sound or a combination of sound and light, so as to configure a security system.

In the embodiment, the connecting unit 120 can be connected to the portable electronic device 10 via a connecting port or an additional contact switch attached to the portable electronic device 10, which does not limit portable area of the portable electronic device 10 while exhibited, and the high portability brings customers better using experiences.

In the alarm device 100, the control interface CI (such as a power key or an alarm sound rotary knob) of the detection unit 110 can be operated to enable, set or disable the alarm function, and no complicated locking and unlocking operations are required.

Additionally, in the embodiment, the alarm device 100 can selectively include a signal receiving unit 130 and a remote control unit 140. The signal receiving unit 130 may be an infrared receiver, a radio frequency transceiver module or a drive-by-wire switch, which is not limited herein. The remote control unit 140 can be controlled to transmit a control signal (such as an infrared signal, a radio frequency signal and other wireless signals, or a wired signal triggered by pressing a drive-by-wire switch). When the signal receiving unit 130 receives a remote control signal from the remote control unit 140, the received remote control signal is transmitted to the detection unit 110, so as to enable, disable the alarm, or adjust the alarm volume, which is not limited herein.

Figure 2:
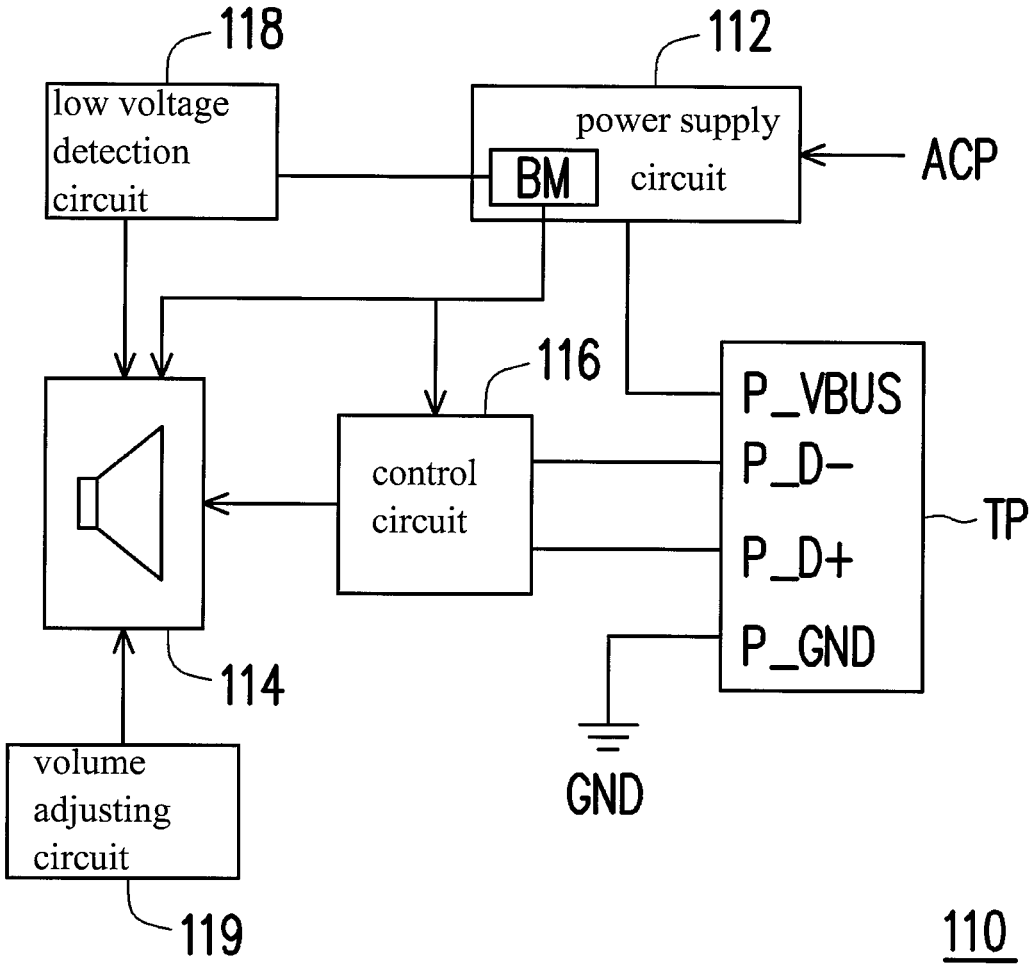
FIG. 2 is a schematic diagram showing a circuit of a detection unit in an embodiment.

FIG. 2 is a schematic diagram showing a circuit of a detection unit in an embodiment. In FIG. 2, the detection unit of the alarm device is further illustrated.

Please refer to FIG. 2, in the embodiment; the detection unit 110 includes a connecting port TP, a power supply circuit 112, an alarm circuit 114, a control circuit 116, a low voltage detection circuit 118 and a volume adjusting circuit 119. In the embodiment, the detection unit 110 is electrically connected to the connecting unit 120 via the connecting port TP which is a universal serial bus (USB) port, and the data transfer pin of the detection unit 110 may be a data transfer pin P_D− or P_D+ of the connecting port TP, which is not limited herein. Additionally, the connecting port TP further includes a power pin P_VBUS and a grounding pin P_GND. The power pin P_VBUS is connected to the power supply circuit 112. The data transfer pins P_D− and P_D+ are connected to the control circuit 116. The grounding pin P_GND is connected to the grounding terminal GND of the detection unit 110.

The power supply circuit 112 includes a battery module BM, and it also can receive an external alternating current power ACP. The external alternating current power ACP can be converted to the operation power for each circuit. When the external alternating current power ACP is cut, the battery module BM of the power supply circuit 112 provides power to the detection unit 110. The alarm circuit 114 is coupled to the power supply circuit 112. The alarm circuit 114 may be a buzzer circuit or other circuits which can make a sound or give out a light. The control circuit 160 is coupled to the connecting port TP, the power supply circuit 112 and the alarm circuit 114. The control circuit 116 presets the electric potential of the data transfer pin P_D− or P_D+ of the connecting port TP to the first electric potential (such as a high electric potential 5V of a USB port). Then, the control unit 160 determines whether the portable electronic device 10 is disconnected by detecting an electric potential change of the data transfer pin, and it further controls the alarm circuit 114 to issue an alarm accordingly.

In the detection mode, when the alarm circuit 114 issues an alarm, the alarm must be turned off by the remote control unit or setting the detection unit 110. Thus, if the portable electronic device 10 is electrically connected to the detection unit 110 again via the connecting unit 120, and the electric potential of the data transfer pin P_D− or P_D+ is switched from the first electric potential to the second electric potential, the alarm continues, thus to avoid that a thief operates to disable the alarm, for example, the thief makes the portable electronic device connected to the connecting unit again, or replace the portable electronic device by other products.

For example, when the control circuit 116 presets the electric potential of the data transfer pin to the high electric potential (such as 5V) and the control circuit 116 detects the electric potential of the data transfer pin P_D− is switched from the high electric potential to the grounding electric potential, the control circuit 116 determines the portable electronic device 10 is electrically connected to the detection unit 110 via the connecting unit 120, and is set in a detection mode. In the detection mode, the control circuit 116 continuously detects whether the electric potential of the data transfer pin P_D− changes. If the control circuit 116 detects the electric potential of the data transfer pin P_D− is switched from the grounding electric potential to the high electric potential, it indicates the portable electronic device 10 may be disconnected from the connecting unit 120. The control circuit 16 immediately controls the alarm circuit 114 to issue an alarm.

Additionally, in an embodiment, the alarm can be controlled by the detection unit 110 and generated by the portable electronic device 10 itself. In the embodiment, the alarm issued by the portable electronic device 10 also needs to be turned off via the detection unit 110, and it cannot be turned off by the portable electronic device 10 itself, however, in an embodiment, the alarm can be turned off by the portable electronic device 10, which is not limited herein.

In another embodiment, the detection unit 110 can further adapted with an uninterruptable power supply (UPS) via the switch of the power source of the power supply circuit 112, so as to avoid that the alarm device 100 is disabled when the power cut. In detail, in the embodiment, the power supply circuit 112 determines whether it receives the external alternating current power ACP. When the power supply circuit 112 receives the external alternating current power ACP, the power supply circuit 112 takes the external alternating current power ACP as the power source. On the contrary, when the power supply circuit 112 does not receive the external alternating current power ACP, the power supply circuit 112 switches to the battery module BM as the main power source, and maintains the normal operation of the alarm device 100.

Additionally, in the embodiment, the low voltage detection circuit 118 detects whether a voltage of the battery module is lower than a critical value (defined by the user), and controls the alarm circuit 114 to issue an alarm indicating that the power of the battery module BM is low. The volume adjusting circuit 119 adjusts an alarm volume of the alarm circuit 114. The volume adjusting circuit 119 provides a control interface, such as a rotary knob, and the user can control the volume adjusting circuit 119 to adjust the volume of the alarm circuit 114 via the control interface. The low voltage detection circuit 118 and the volume adjusting circuit 119 can be selectively disposed in the detection unit 110, which is not limited herein.

FIG. 3 to FIG. 8 are schematic diagrams showing a connecting unit of an alarm device in different embodiments.

Figure 3:
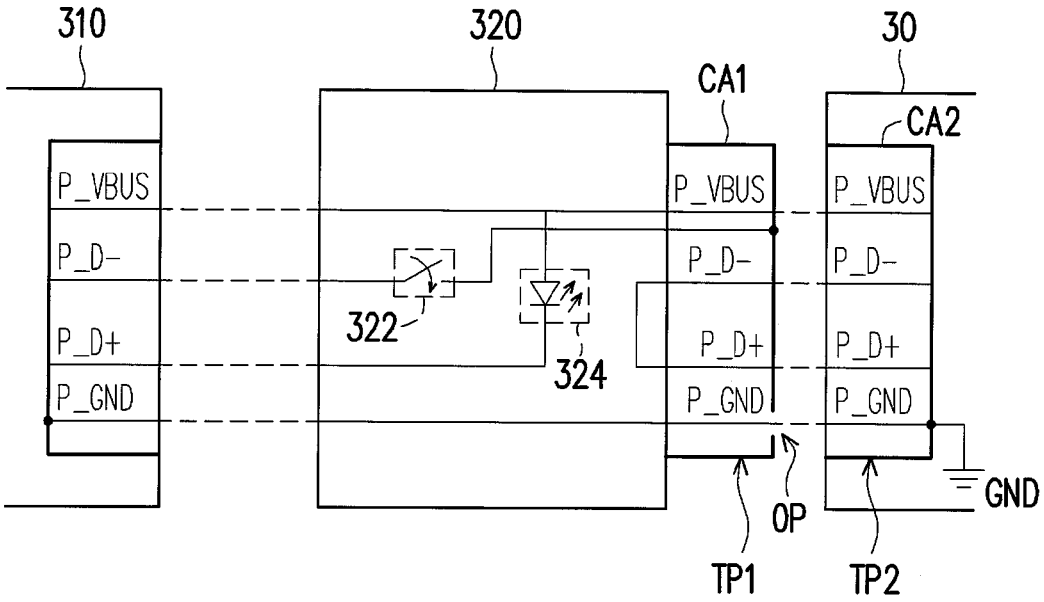
FIG. 3 is a schematic diagram showing a circuit of a connecting unit in the first embodiment.

Please refer to FIG. 3; FIG. 3 is a schematic diagram showing a circuit of a connecting unit in the first embodiment. In the embodiment, a connecting unit 320 includes a connecting port TP1, a casing CA1, a contact switch 322 and a light emitting module 324. The connecting port TP1 is electrically connected to a detection unit 310 and a connecting port TP2 of a portable electronic device 30. The connecting port TP1 of the connecting unit 320 and the connecting port TP2 of the portable electronic device 30 are such as universal serial bus (USB) ports, and they includes corresponding power pins P_VBUS, data transfer pins P_D− and P_D+ and grounding pins P_GND, respectively. The connecting unit 320 may also be electrically connected to the detection unit 310 via connecting ports which have same transmission interfaces, or the detection unit 310 is electrically connected to the connecting port TP1 via an embedded circuit, which is not limited herein.

When the connecting ports which have same transmission interfaces are used to connect the detection unit 310 and the connecting unit 320, the transmission interfaces of each group of the connecting ports may be the same or different, which is not limited herein. In practice, as long as the transmission interfaces of the connecting ports between the detection unit 310 and the connecting unit 320 are the same, and the transmission interfaces of the connecting ports (such as TP1 and TP2) between the connecting unit 320 and the portable electronic device 30 are the same, the alarm device can normally be operated. he connecting ports can be universal serial bus (USB) ports, which is not limited herein, such as the connecting ports between the detection unit 310 and the connecting unit 320, the connecting ports TP1 and TP2.

The connecting ports TP1 and TP2 can be connected via the casing CA1 and CA2. Referring to FIG. 3, the connecting port TP1 is a male connecting port and the connecting port TP2 is a female connecting port, which is not limited herein.

In the embodiment, the casing CA1 connecting the connecting ports TP1 and TP2 includes an opening OP, and a grounding pin P_GND of the connecting port TP1 and the casing CA1 are electrically independent (which means the grounding pin P_GND of the connecting port TP1 is not connected to the ground). In other words, when the portable electronic device 30 is not connected to the connecting unit 320, the casing CA1 of the connecting unit 320 is at a floating state, and the floating state is a state without reference electric potential. When the portable electronic device 30 is connected to the connecting unit 320, the grounding pin P_GND of the connecting port TP1 is connected to the ground via the casing CA2. The casing CA1 is preset to be at the floating state by forming an opening at the casing, which is not limited herein.

The contact switch 322 is connected between the data transfer pin P_D− of the detection unit 310 and the casing CA1 in series, and the contact switch 322 may be a metal dome sheet, which is not limited herein. When the contact switch 322 is conducted, the casing CA1 contacts the casing CA2, the grounding pin P_GND of the connecting port TP2 and the data transfer pin P_D− of the detection unit 320 are short-circuited and are at the same electric potential. On the contrary, when the contact switch 322 is cut-off, the electric potential of the casing CA1 is at the preset floating state.

The power pins P_VBUS of the connecting port TP1 and the detection unit 310 are electrically connected with each other to provide a power transmission path, which makes the power of the detection unit 310 provided to the portable electronic device 30 via the power transmission path.

The light emitting module 324 is electrically connected to the power pin P_VBUS of the connecting port TP1. When the connecting unit 320 is connected to the detection unit 310 and the portable electronic device 30 via the connecting ports TP1 and TP2, the light emitting module 324 is conducted and emits light to indicate that the alarm device is in the detection mode. The light emitting module 324 may include a light emitting diode and resistors, which is not limited herein.

The data transfer pins P_D− and P_D+ of the first connecting port TP1 are short-circuited in the embodiment. When the portable electronic device 30 is connected to the connecting unit 320, the portable electronic device 30 is set in a quick charging mode in response to the short-circuited data transfer pins P_D− and P_D+, so as to increase the charging efficiency of the detection unit 310.

Figure 4A:
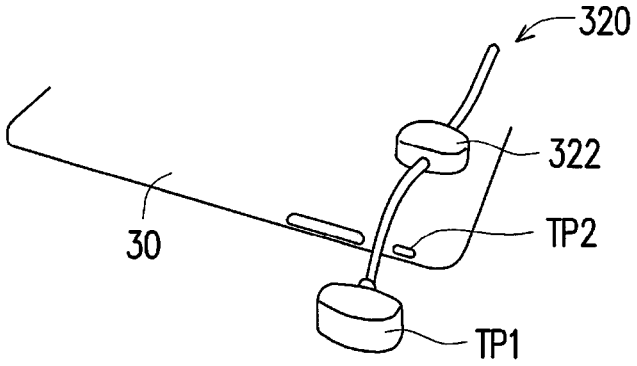
FIG. 4A to FIG. 4C are schematic diagrams showing an alarm device with the connecting unit in FIG. 3.
Figure 4B:
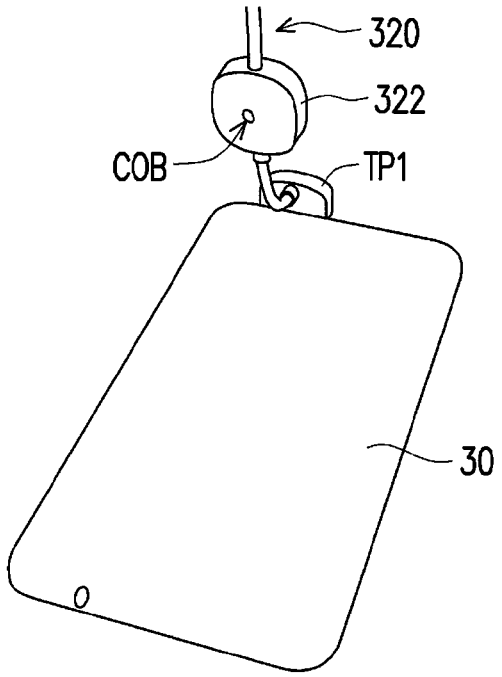
Figure 4C:
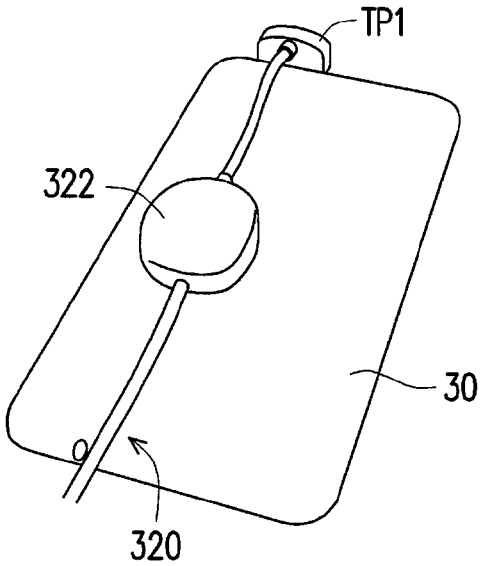

FIG. 4A to FIG. 4C are schematic diagrams showing configuration and operation of an alarm device. In the embodiment, the portable electronic device 30 may be a mobile phone, which is not limited herein.

Please refer to FIG. 3 and FIG. 4A, when the detection unit 310 is connected to the mobile phone 30 via the connecting unit 320, the mobile phone 30 is connected to the connecting unit 320 via the corresponding connecting ports TP1 and TP2.

On the other hand, referring to FIG. 4B, the contact switch 322 may include a protruding part COB. The protruding part COB is movably disposed on the contact switch 322 and it can generate a displacement according to a force applied thereon. When the displacement of the protruding part COB equals to or is larger than a threshold value (defined by the user), the contact switch 322 is conducted. When the displacement of the protruding part COB is smaller than the threshold value, the contact switch is cut-off. In the embodiment, the protruding part COB of the contact switch 322 can generate a displacement larger than a threshold by attaching to a surface of the mobile phone 30, so as to conduct the contact switch 322.

Referring to FIG. 4C, when the corresponding connecting ports TP1 and TP2 are electrically connected and the contact switch 322 is attached to the surface of the mobile phone 30 (the contact switch 322 is attached to a back cover of the mobile phone 30 as an example), the data transfer pin P_D− of the detection unit 310 is electrically connected to the grounding terminal GND of the mobile phone 30 via the contact switch 322, the data transfer pin P_D− of the connecting port TP1, and the casings CA1 and CA2, as shown in FIG. 3. Thus, the electric potential of the data transfer pin P_D− of the detection unit 310 is switched from the high electric potential to the grounding electric potential, and the detection unit 310 is set in the detection mode according to the electric potential change of the data transfer pin P_D−.

In the detection mode (as shown in FIG. 4C), once the connecting port TP1 of the connecting unit 320 is removed from the mobile phone 30, or the contact switch 322 is removed from the back cover of the mobile phone 30, the short circuit formed by the contact switch 322 and the casing CA1 is cut, and the electric potential of the data transfer pin P_D− of the connecting port TP1 is switched back to the high electric potential again. At the moment, the detection unit 310 issues an alarm to warn that the mobile phone 30 may be stolen.

Figure 5:
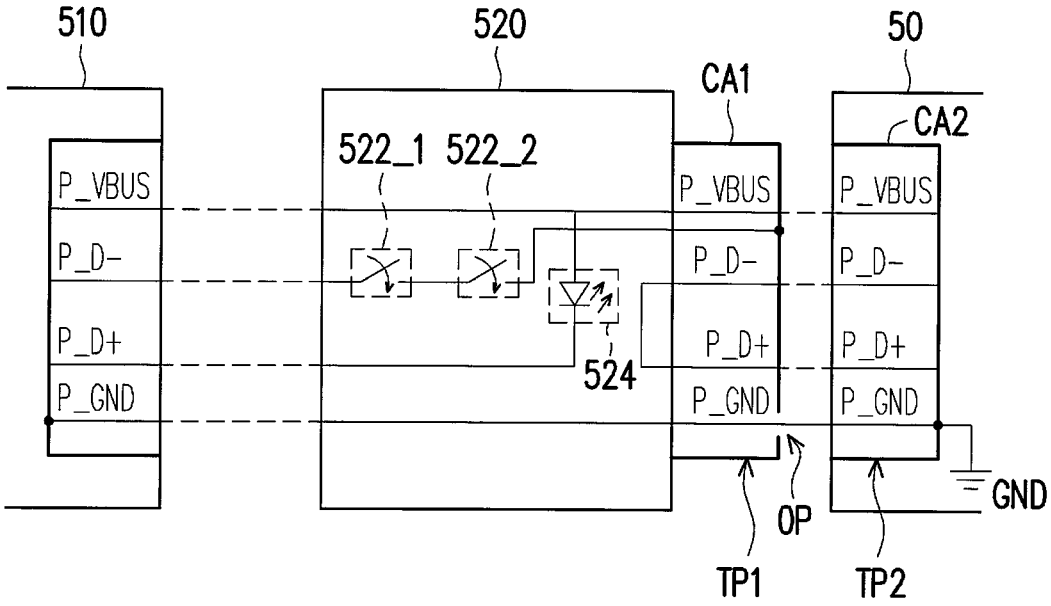
FIG. 5 is a schematic diagram showing a circuit of a connecting unit in the second embodiment.

Referring to FIG. 5, FIG. 5 is a schematic diagram showing a circuit of a connecting unit in the second embodiment. In the embodiment, a connecting unit 520 includes a connecting port TP1, a casing CA1, multiple contact switches (such as 522_1 and 522_2) and a light emitting module 524. The structure and the operation of the connecting unit 520 are similar with those of the connecting unit 320 in the previous embodiments. The main difference is that the connecting unit 520 includes multiple contact switches 522_1 and 522_2 which are connected in series.

Figure 6:
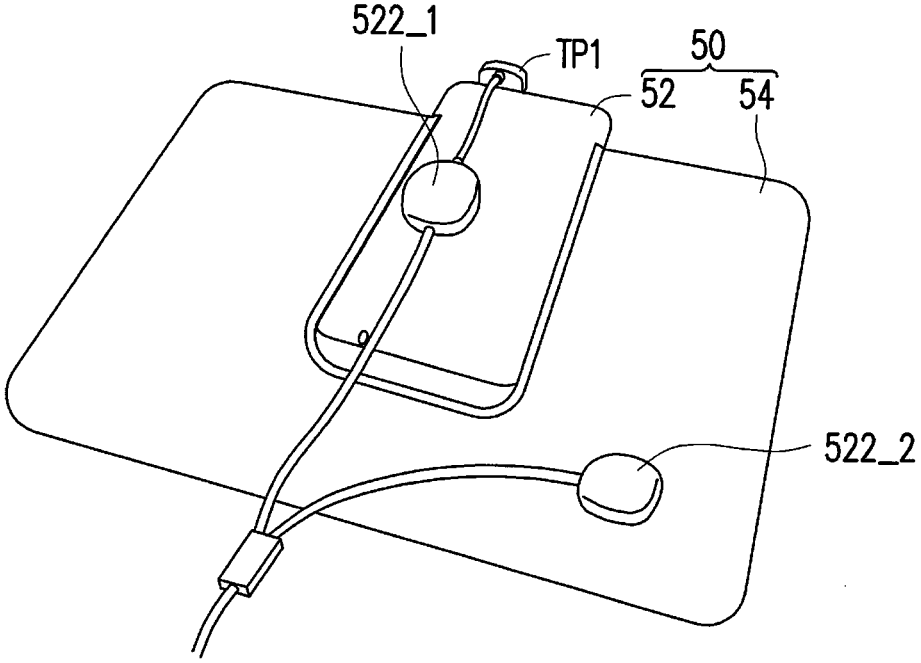
FIG. 6 is a schematic diagram showing an alarm device with the connecting unit in FIG. 5 in the second embodiment.

In detail, the connecting unit 520 can be applied to a tablet mobile phone, which is a portable electronic device 50 including a mobile phone and a tablet computer. Referring to FIG. 6, if the portable electronic device 50 is a tablet mobile phone, the portable electronic device 50 includes a mobile phone 52 and a tablet 54. The connecting port TP1 of the connecting unit 520 is electrically connected to a connecting port TP2 of the mobile phone 52, and the contact switch 522_1 is attached to the back cover of the mobile phone 52 (which is not limited herein). On the other hand, the contact switch 522_2 is attached to the back cover of the tablet 54 (which is not limited herein). A data transfer pin P_D− of a detection unit 510 is electrically connected to the grounding terminal GND of the tablet mobile phone 50 via the contact switches 522_1 and 522_2, the data transfer pin P_D− of the connecting port TP1, and the casings CA1 and CA2. Thus, the electric potential of the data transfer pin P_D− of the connecting port TP1 is switched from the high electric potential to the grounding electric potential, and the detection unit 510 is set in the detection mode according to the electric potential change of the data transfer pin P_D−.

In the detection mode (as shown in FIG. 6), regardless of that the contact switch 522_1 at the mobile phone 52 of the tablet mobile phone 50, or the contact switch 522_2 at the tablet 54 is removed, or the connecting port TP1 of the connecting unit 520 is removed, a short circuit formed by the contact switches 522_1, 522_2 and the casing CA1 is cut, and the electric potential of the data transfer pin P_D− of the detection unit 510 is switched to issue an alarm. The alarm device in the embodiment provides a better security mechanism for the portable electronic device 50, such as the tablet mobile phone, via the connecting unit 520.

Figure 7:
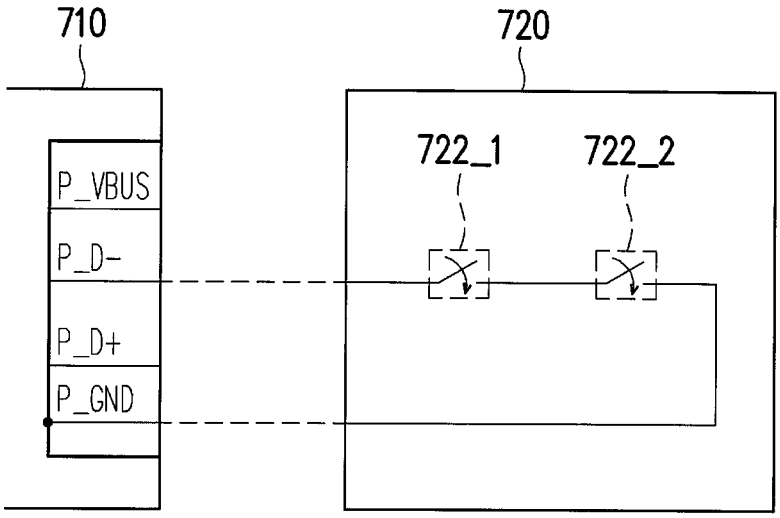
FIG. 7 is a schematic diagram showing a circuit of a connecting unit in the third embodiment.

Referring to FIG. 7, FIG. 7 is a schematic diagram showing a circuit of a connecting unit in the third embodiment. In the embodiment, a connecting unit 720 includes multiple contact switches (such as 722_1 and 722_2). The difference between the third embodiment and the previous embodiments is that the connecting unit 720 is connected to the portable electronic device 70 only via the contact switches 722_1 and 722_2 connected in series, and no additional connecting port is needed. The contact switches 722_1 and 722_2 are connected in series between a data transfer pin P_D− and the grounding pin P_GND of a detection unit 710. When the contact switches 722_1 and 722_2 are conducted, the data transfer pin P_D− of the detection unit 710 is short-circuited with the grounding pin P_GND via the contact switches 722_1 and 722_2, and the electric potential of the data transfer pin P_D− of the detection unit 710 is switched from high electric potential to the grounding electric potential. In other words, in the embodiment, although the connecting unit 720 is connected to the portable electronic device 70 only via the contact switches 722_1 and 722_2, it can also determine whether the portable electronic device 70 is detached from the connecting unit 720 by detecting the electric potential of the data transfer pin P_D− of the detecting unit 710.

Figure 8:
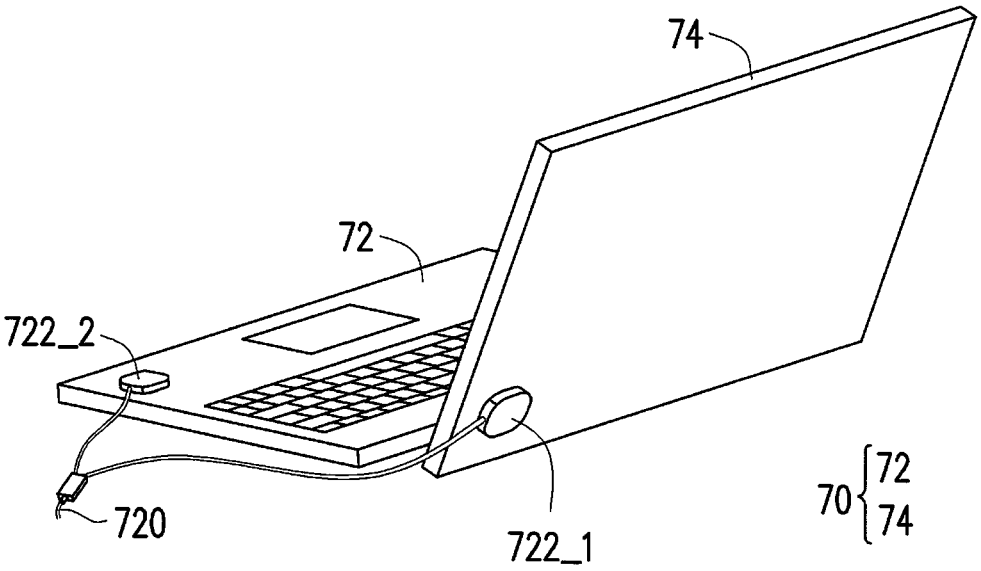
FIG. 8 is a schematic diagram showing an alarm device with the connecting unit in FIG. 7 in the third embodiment.

In detail, the connecting unit 720 can be applied to a notebook computer or a transformer tablet computer (whose base can be detached from a touch screen). Referring to FIG. 8, if the portable electronic device 70 is a transformer tablet computer, the portable electronic device 70 includes a base 72 and a tablet 74. In the embodiment, the contact switch 722_1 of the connecting unit 720 can be attached to a back cover of the tablet 74. On the other hand, the contact switch 722_2 can be attached to the base 72. The data transfer pin P_D− of the detection unit 710 is electrically connected to the grounding pin P_GND of the detection unit 710 via the data transfer pin P_D− of the connecting unit 720 and the contact switches 722_1 and 722_2. Thus, the electric potential of the data transfer pin P_D− of the detection unit 710 is switched from the high electric potential to the grounding electric potential, and the detection unit 710 is set in the detection mode according to the electric potential change of the data transfer pin P_D−.

In the detection mode (as shown in FIG. 8), regardless of that the contact switch 722_2 at the base 72 of the transformer tablet computer 70 or the contact switch 722_1 at the tablet 74 is removed, the short circuit formed by the contact switches 722_1 and 722_2 is cut, and the electric potential of the data transfer pin P_D– of the detection unit 710 is switched to issue an alarm. The alarm device in the embodiment provides a better security mechanism for the portable electronic device 70, such as the transformer tablet computer, via the connecting unit 720.

As stated above, the connecting unit of the alarm device is specifically configured, and the electric potential of the data transfer pin of the connecting port of the detection unit is different when the connecting port is disconnected or connected to the portable electronic device. Thus, the detection unit determines whether the portable electronic device is disconnected via detecting the electric potential of the data transfer pin. Since the connecting unit can be connected to the portable electronic device via a connecting port or an additional contact switch, a portable area of the portable electronic device is thus no limited. When the portable electronic device is under exhibited, a high portability brings customers better using experiences. Moreover, in the alarm device, a control interface (such as a power key, an alarm sound rotary knob) of the detection unit or a remote control unit can be used to enable, set or disable the alarm function. No complicated locking and unlocking are required to set the alarm system in the present disclosure.

Although the present disclosure has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. An alarm device for warning of an attempt to remove a portable electronic device, applied to a data port of the portable electronic device, the data port of the portable electronic device comprising: a power pin, a first data transfer pin, a second data transfer pin, a ground pin, and a conductive casing, wherein the ground pin and the conductive casing of the data port are electrically connected to a ground terminal of the portable electronic device; the alarm device comprising:

a detection unit comprising: a power connection, a first data transfer connection, a second data transfer connection, and a ground connection, wherein the first data transfer connection is preset to a first electric potential; and a connecting unit comprising a connecting port and a contact switch, the connecting port comprising: a power pin, a first data transfer pin, a second data transfer pin, a ground pin, and a conductive casing, wherein the connecting port is configured to plug with the data port of the portable electronic device, electrically connecting respective pins and casings, the contact switch is electrically connected in series between the first data transfer connection of the detection unit and the casing of the connecting port;

wherein the alarm device is set in detection mode when the connecting port is electrically connected to the data port of the portable electronic device, and the contact switch is attached to the portable electronic device to close the contact switch and thereby electrically connect the first data transfer connection of the detection unit to ground potential through interconnection of the connection unit and the data port;

wherein the detection unit issues an alarm when electric potential of the first data transfer connection is detected to be switched from ground potential to the first electric potential due to interruption of the interconnection and/or a contact switch state change while in the detection mode.

2. The alarm device according to claim 1, wherein the portable electronic device includes:

the data port which is electrically connected to the connecting port, wherein the the first data transfer pin and the second data transfer pin of the data port correspond to the first data transfer pin and second data transfer pin respectively of the connecting port.

3. The alarm device according to claim 2, wherein in the detection mode, when the connecting port is separated from the data port, the detection unit issues the alarm.

4. The alarm device according to claim 1, wherein the casing of the connecting port includes an opening and is electrically independent of the grounding pin of the connecting port.

5. The alarm device according to claim 1, wherein the contact switch includes a protruding part, when a displacement of the protruding part equals to or is larger than a threshold value, the contact switch is conducted, and when the displacement of the protruding part is smaller than the threshold value, the contact switch is cut-off.

6. The alarm device according to claim 1, wherein when the portable electronic device is electrically connected to the detection unit via the connecting unit, the detection unit provides power to the portable electronic device via the power pin.

7. The alarm device according to claim 6, wherein the second data transfer pin and the first data transfer pin of the connecting port are short-circuited.

8. The alarm device according to claim 1, wherein the connecting unit includes:

multiple contact switches electrically connected between the first data transfer connection of the detection unit and the grounding pin of the connecting port.

9. The alarm device according to claim 1, wherein the detection unit includes:

a power supply circuit including a battery module to generate power for operation of the detection unit;

an alarm circuit coupled to the power supply circuit to issue the alarm; and a control circuit coupled to the power supply circuit, the alarm circuit and the connecting port of the connecting unit, wherein the control circuit detects an electric potential change at the first data transfer connection of the detection unit, and controls the alarm circuit according to the electric potential change.

10. The alarm device according to claim 9, wherein when the power supply circuit receives an external alternating current power supply, the external alternating current power supply is taken as a power supply source, and when the power supply circuit does not receive the external alternating current power supply, the battery module is taken as the power supply source.

11. The alarm device according to claim 9, wherein the detection unit further includes:

a low voltage detection circuit detecting whether a voltage of the battery module is lower than a critical value and controlling the alarm circuit to issue a low voltage alarm.

12. The alarm device according to claim 9, wherein the detection further includes:

a volume adjusting circuit adjusting a sound volume of the alarm circuit.

13. The alarm device according to claim 1, wherein the alarm device further includes:

a remote control unit sending a remote control signal; and a signal receiving unit coupled to the detection unit, receiving the remote control signal and transmitting the remote control signal to the detection unit as a control basis.

14. The alarm device according to claim 1, wherein the detection unit further includes:

a control interface setting a control function of the alarm device.

* * * * *